United States Patent [19]

Sorimachi

[11] 4,424,606

[45] Jan. 10, 1984

[54] HINGE FOR OPENING AND CLOSING A DUST COVER

[75] Inventor: Akira Sorimachi, Yokohama, Japan

[73] Assignee: Katoh Electrical Machinery Co. Ltd., Yokohama, Japan

[21] Appl. No.: 293,215

[22] PCT Filed: Dec. 22, 1980

[86] PCT No.: PCT/JP80/00319

§ 371 Date: Aug. 10, 1981

§ 102(e) Date: Aug. 10, 1981

[87] PCT Pub. No.: WO81/01900

PCT Pub. Date: Jul. 9, 1981

[51] Int. Cl.[3] ..... E05F 1/10

[52] U.S. Cl. ..... 16/223; 16/289; 16/292; 16/296; 16/297; 16/321; 16/332; 16/352; 369/75.1

[58] Field of Search ..... 274/2, 1 R; 369/75; 220/335; 16/244, 245, 248, 238, 223, 262, 264, 265, 307, 308, 386, 243, 289, 296, 352, 292, 297, 325, 324, 321, 332, 258

[56] References Cited

U.S. PATENT DOCUMENTS

| | | | |
|---|---|---|---|
| 2,743,476 | 5/1956 | Turner | 16/289 |
| 4,356,594 | 11/1982 | Grosemans | 16/342 X |

FOREIGN PATENT DOCUMENTS

| | | | |
|---|---|---|---|
| 33697 | 9/1934 | Netherlands | 16/292 |
| 313799 | 6/1929 | United Kingdom | 16/296 |

*Primary Examiner*—Mark Rosenbaum

*Attorney, Agent, or Firm*—George B. Oujevolk

[57] ABSTRACT

This invention deals with a hinge for opening or closing a dust cover of record players, which, in order to keep the hinge body from being exposed, to prevent the opened dust cover from excessively projecting rearwardly and to stably sustain the dust cover at an intermediate opening angle, comprises: a cabinet; a dust cover; a slider disposed vertically slidable in the rear portion of the cabinet on each side; a spring urging the slider upward; a support member removably mounted to the dust cover and rotatably mounted on the cabinet by a hinge pin; and a follower provided to the support member and adapted to contact the head of the slider. The hinge of this invention may be provided, in addition to the above construction, with a means to stably sustain the dust cover at an intermediate opening angle.

3 Claims, 11 Drawing Figures

HINGE FOR OPENING AND CLOSING A DUST COVER

DESCRIPTION

BACKGROUND OF THE INVENTION

This invention relates to a hinge for opening and closing the dust cover of record players.

BRIEF DESCRIPTION OF THE PRIOR ART

This kind of dust cover hinge generally has a means for offsetting or balancing the weight of the dust cover so as to prevent the dust cover from closing abruptly and causing the stylus to jump out of the record groove, and to facilitate the operation of setting the record onto the turntable as well as the lead-in operation of the tone arm.

What is generally called a rear hinge, mounted between the rear portion of the record player cabinet and the rear portion of the dust cover, has a disadvantage that being exposed at the back of the record player, the rear hinge mars the beauty of the record player as furniture. The rear hinge also has another drawback that when the dust cover is opened the rear portion of the dust cover projects further from the back of the cabinet, thus requiring an extra space when installing the record player to allow for that projection.

Another commonly used hinge, a so-called side hinge, is fitted between the rear side portion of the record player cabinet and the rear side portion of the dust cover. With the side hinge, the pivoting axis of the dust cover is located a certain distance in front of the rotating axis for the rear hinge. Thus, to this extent, the rear portion of the dust cover can be prevented from projecting backward. But it has a disadvantage that the rear lower end of the dust cover must either be split in two or removed, so that dust is likely to get in through this portion.

It is known that the curve of torque required to open or close the dust cover corresponds to a sine curve as indicated by the solid line in FIG. 6. It is therefore desirable that the device for opening or closing the dust cover have the torque characteristic as shown by the dotted curve of FIG. 6 in order for the device to perform the functions described above.

SUMMARY OF INVENTION

The object of this invention is to provide a dust cover hinge for the record player which has the necessary torque characteristic and various functions required of this kind of dust cover opening-closing device and which overcomes various drawbacks of the aforementioned conventional devices.

To achieve this objective, this invetion comprises: a cabinet; a dust cover; a slider inserted in the rear end portion of the cabinet on each side in such a manner that it can be moved vertically; a spring urgint the slider upward; a support member removably attached to the dust cover and rotatably fitted to the cabinet by means of a hinge pin; and a follower provided to the support member which contacts the head portion of the slider.

With this construction, this invention can achieve the aforementioned object, as will be explained in the following, detailed description and the accompanying drawings, in which:

BEST MODE FOR CARRYING OUT THE INVENTION

Figure 1:
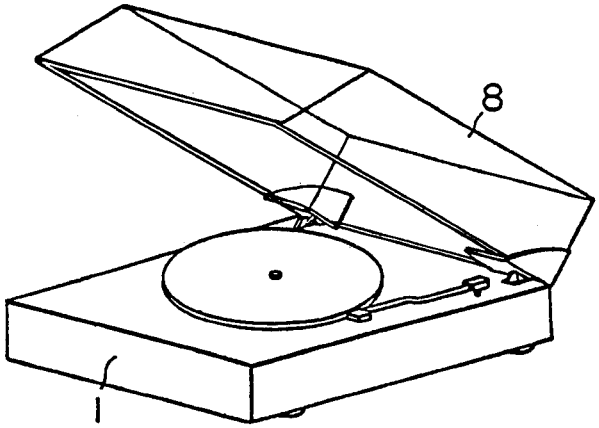
FIG. 1 is a perspective view of the record player using the hinge of this invention for opening and closing the dust cover.
Figure 2:
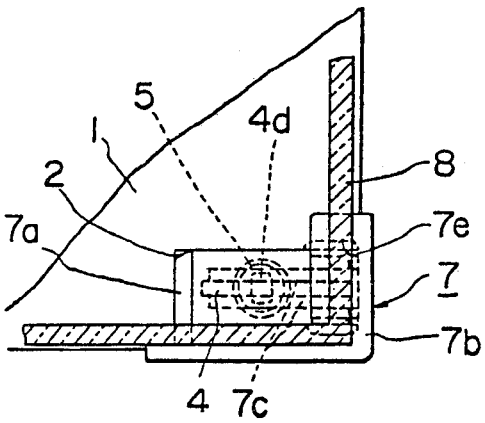
FIG. 2 is a horizontal cross-sectional view of the hinge.
Figure 3:
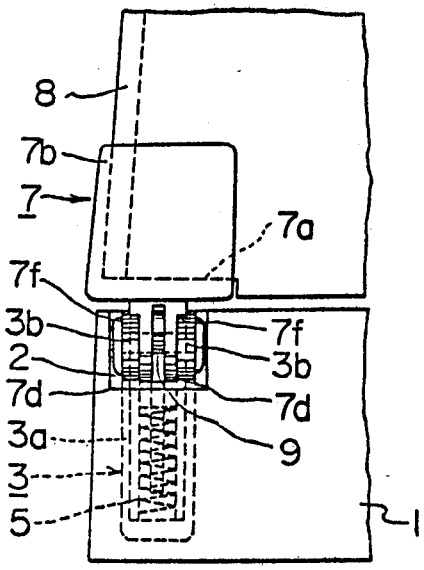
FIG. 3 is a rear elevation of the same portion.
Figure 4:
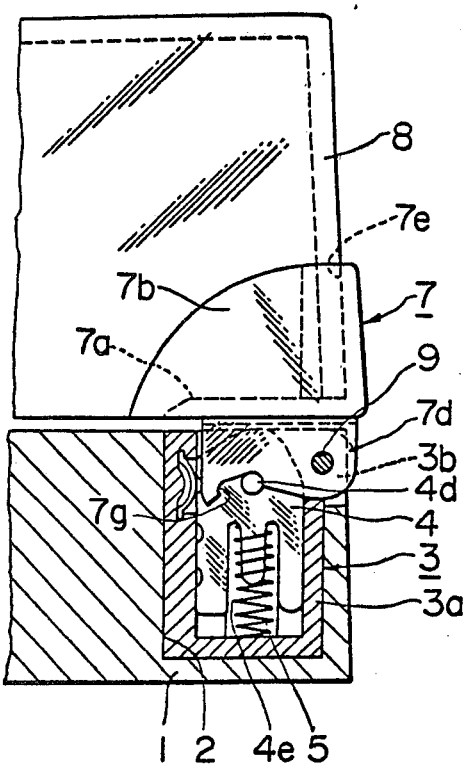
FIG. 4 is a side view of the vertical cross section of the same portion.
Figure 5:
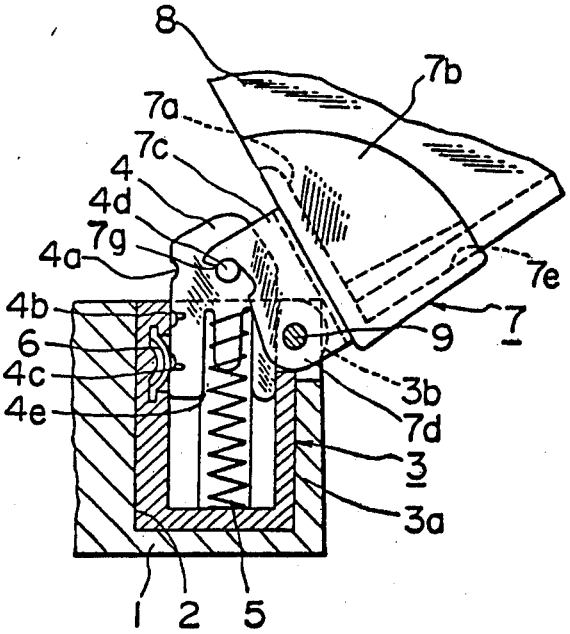
FIG. 5 is a vertical cross section of the same portion as viewed from the side with the dust curve opened.
Figure 6:
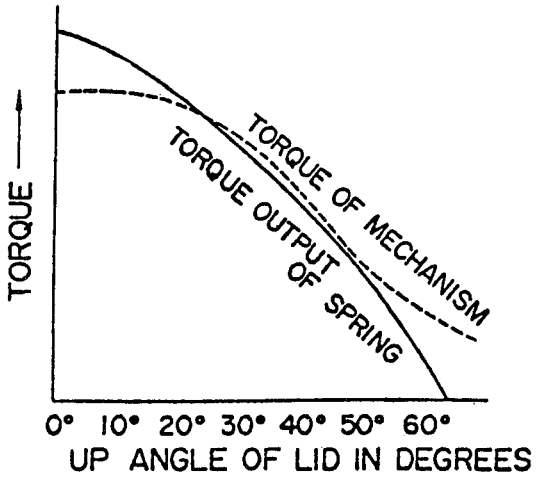
FIG. 6 is a graph showing the torque corve of the dust cover and the ideal torque curve of the hinge for opening and closing the dust cover.
Figure 7:
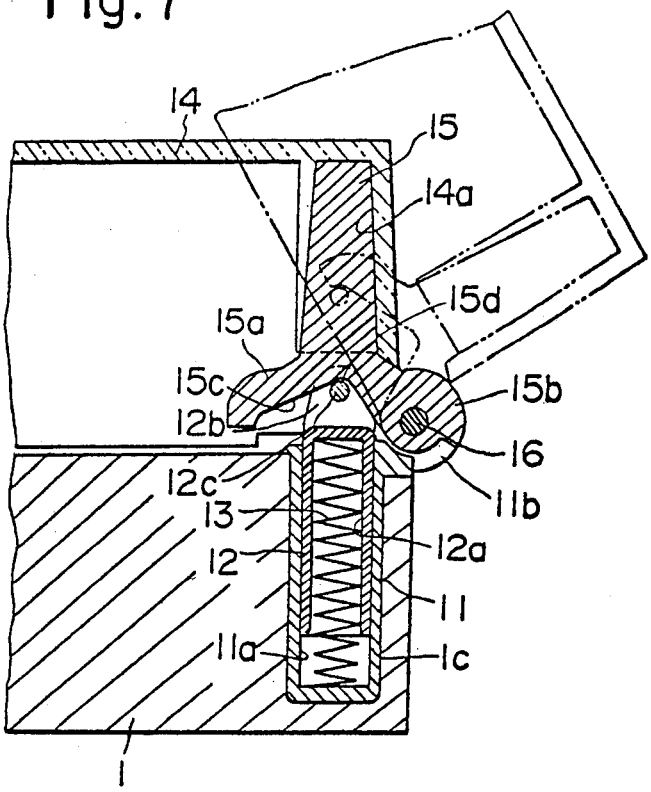
FIG. 7 is a partial cross section of another embodiment as viewed from the side.
Figure 8:
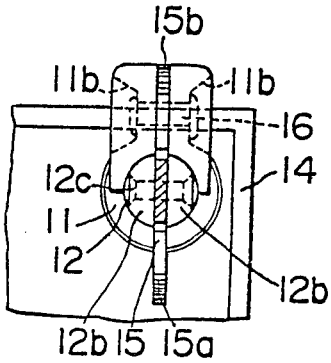
FIG. 8 is a plan view of the same portion.

Now, we will explain in detail one embodiment of this invention referring to the accompanying drawings. In FIGS. 1 through 5, the dust cover hinge of this invention is fitted to each of two rear side portions of the record player cabinet 1. Fitted in a receiver hole 2 formed in the rear side portion of the cabinet 1 is a support member 3 which constitutes one of two hinge components and consists of a spring case 3*a* and hinge pin supports 3*b*, 3*b*. The receiver hole 2 is open at its upper rear end and upper portion. A flat slider 4, received vertically slidably in the spring case 3*a*, has a plurality of recesses 4*a*, 4*b*, 4*c* formed one upon the other in its front portion, an acting pin 4*d* horizontally passing through the upper portion of the slider 4, and a spring insertion hole 4*e* formed in the lower portion of the slider 4. Resiliently fitted between the slider 4 and the bottom of the spring case 3*a* is a compression coil spring 5, a part of which is inserted into the spring insertion hole 4*e*. A leaf spring 6 is mounted in the inner wall of the spring case 3*a* so that it engages with the recesses 4*a*, 4*b*, 4*c* of the slider 4 in that order.

A support member 7 is another one of the hinge components, which consists of a base plate 7*a*, a dust cover holder 7*b*, angle-shaped and erected on the base plate 7*a*, followers 7*c*, 7*c* had hook portions 7*g*, 7*g* and provided under the bottom of the base plate 7*a*, and hinge pin supports 7*d*, 7*d*. The rear end of the dust cover 8 is securely fitted into the angle-shaped longitudinal groove 7*e* formed in the dust cover holder 7*b*. The hook-shaped followers 7*c*, 7*c* are made to engage with the both sides of the acting pin 4*d* projecting from each side of the slider 4. The hinge pin supports 7*d*, 7*d* are rotatably mounted to the hinge pin supports 3*b*, 3*b* of the support member 3 by means of a hinge pin 9.

As another example, the followers 7*c*, 7*c* may be formed with a slit with which to engage the acting pin 4*d*. As a means for restricting the vertical motion of the slider 4 to a predetermined position, the slider may be provided with a projection and the spring case 3*a* may be formed with a recess to engage with that projection.

Now, we will explain the action of the dust cover hinge of this invention. As shown in FIGS. 2 through 5, with the dust cover 8 closed, the slider 4 is pushed by the followers 7c, 7c of the support member 7 through the acting pin 4d, down to the lowest position against the force of the compression coil spring 5, so that the leaf spring 6 is engaged with the recess 4a to hold the dust cover 8 closed. The support member 3 is installed into the receiver hole 2 and is not exposed toward the rear portion of the cabinet 1.

When the dust cover 8 is opened by lifting its front portion, the following action will take place. As the compression coil spring 5 always urges, through the slider 4 and the acting pin 4d, the hook-shaped followers 7c, 7c of the support member 7 to rotate to the open position, the dust cover 8 can be opened easily by an operator who will feel almost no resistance or weight after having felt a small resistance when the leaf spring 6 disengaged from the recess 4a of the slider 4. In this embodiment when the dust cover 8 is opened about 35°, the leaf spring 6 engages with the next recess 4b of the slider 4 and the resilient force of the spring 5 almost balances with the weight of the dust cover 8, so that the dust cover 8 becomes stable and sustains itself at this position and will not move to open or close even if the operator's hand is removed from it or if a small external impact is applied to it.

When the dust cover 8 is opened further, the operator will feel a small resistance produced as the leaf spring 6 comes off the recess 4b of the slider 4. But after this slight resistance is felt, the dust cover 8 can be moved smoothly and easily because of the resilient force of the compression coil spring 5 with the operator feeling almost no weight of the cover 8. At the opening angle of 65° the dust cover 8 becomes balanced and sustains itself because the leaf spring 6 engages with the recess 4c of the slider 4 and because the force of the spring 6 is not strong enough to release the leaf spring 6 from the recess 4c. At this time, the steps 7f, 7f formed on the hinge pin supports 7d, 7d of the support member 7 comes in contact with the rear portion of the spring case 3a, thus preventing the dust cover 8 from being further opened. The acting pin 4d is engaged with the hook portions 7g, 7g of the followers 7c, 7c, thus preventing the slider 4 from being slipped out of spring case 3a.

Next, when the dust cover 8 is closed, the action of moving the cover 8 down causes the slider 4 pressed by the hook-shaped followers 7c, 7c through the acting pin 4d to be lowered against the force of the spring 5. The dust cover 8 then balances itself at an angle of about 35° for the reasons described earlier. If pressed down further, the dust cover 8 closes completely. It should also be noted that as it is closed the dust cover 8 is prevented from closing abruptly by the resilient force of the compression coil spring 5.

When the dust cover 8 is to be removed from the cabinet 1, the following steps are taken. In removing only the dust cover 8 from the hinge, the rear end portion of the dust cover 8 is pulled out of the dust cover holder 7b. It is also possible to remove the dust cover 8 together with the hinges from the cabinet 1 by pulling up the spring case 3a of hinge from the receiver hole 2.

When the dust cover 8 is to be mounted to the cabinet 1, the following steps are taken. Where only the dust cover 8 was removed, the rear end portion on each side of the dust cover 8 is held close to the longitudinal groove 7e formed in the dust cover holder 7b of the support member 7 and then pushed down into the groove 7b. For the case where the dust cover 8 was removed together with the hinge, the spring case 3a of the support member 3 is held close to the opening of the receiver hole 2 and pushed down into it.

FIGS. 7 through 10 show another embodiment. As shown in these figures, fitted into a receiver hole formed in the inner side of the cabinet 1 at the rear end is a hollow cylindrical support member 11 which constitutes one of two hinge components and which consists of a spring case 11a and hinge pin supports 11b, 11b.

A slider 12, installed vertically slidable in the spring case 11a of the support member 11, consists of a hollow spring case 12a, a pair of support-pin holders 12b, 12b projecting from the upper end portion of the spring case 12a, and a support pin 12c passing through the holders 12b, 12b. Between the spring case 12a of the slider 12 and the inner bottom of the support member 11 is placed a compression coil spring 13.

A mounting hole 14a is formed inside of the rear end portion of the dust cover 14 of synthetic resin. Removably inserted into this mounting hole 14a is a support member 15 which constitutes the other one of the hinge components and which is provided at the lower portion with a follower 15a and a mounting portion 15b. The follower 15a has a cam portion 15c which contacts the support pin 12c of the slider 12. The mounting portion 15b of the support member 15 is pivotably mounted to the hinge-pin supports 11b, 11b by the hinge pin 16.

Figure 9:
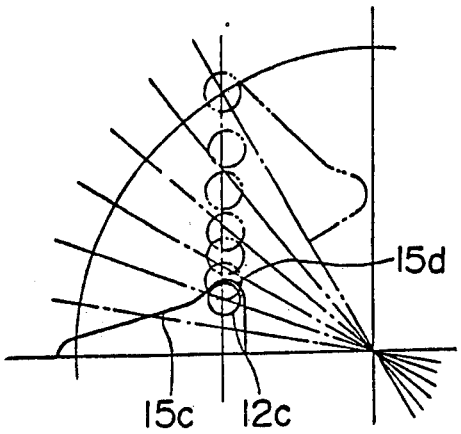
FIG. 9 is an explanatory diagram showing the relation between the cam plate and the support pin.
Figure 10:
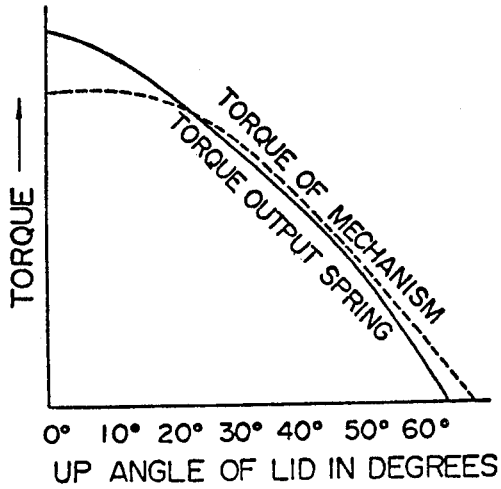
FIG. 10 is a graph showing the torque curve exhibited by the embodiment shown in FIGS. 7 through 9.

If we use a compression coil spring 13 having a force which almost balances with the torque of the dust cover 14 when the cover 14 is opened about 35°, the dust cover 14, when closed, will be stably kept closed since the dust cover weight overcomes the opposing force of the compression coil spring 13. In this condition the support pin 12c mounted on the slider 12 rests under the recess 15d of the cam portion 15c. When the dust cover 14 is opened from the closed condition, it can be smoothly opened without giving a feeling of weight resistance to the operator because of the opposing force of the spring 13. As the dust cover is opened, the contacting position of the support pin 12c of the slider 12 with respect to the cam portion 15c gradually varies with an increasing pitch, as shown in FIG. 9. At the angle from about 20° to 25°, the weight of the dust cover 14 supported by the support pin 12c is balanced by the opposing force of the spring 13 which tends to push the support pin 12c upward, as shown in FIG. 10, so that the dust cover 14 stably sustains itself in this range of opening angle. As the dust cover 14 is further opened from this position, the distance that the support pin 12c moves relative to the cam portion 15c sharply increases, as shown in FIG. 9, shifting the supporting position forward, reducing the weight of the dust cover 14 exerted onto the support pin 12c. As a result, the opposing force of the compression coil spring 13 gradually overcomes the dust cover weight, as shown in FIG. 10, causing the dust cover 14 to be opened automatically.

The dust cover 14, which was opened automatically, comes to a halt when a projection 15b' formed on the mounting portion 15b of the support member 15 abuts against the hinge-pin supports 11b, 11b. This angle is about 60° in this embodiment.

Next, when the dust cover 14 thus opened is to be closed, a certain amount of force is required at the initial stage of closing the cover 14 because the force of the spring 13 is greater than the weight of the dust cover 14. In the range of opening angle of about 45° to 20°, the torque of the dust cover 14 is balanced against the opposing force of the spring 13. At positions beyond 20° in the closing direction, the support pin 12*c* comes into the recess 15*d* of the cam portion 15*c*, and the resilient force of the compression coil spring 13 reduces its rate of increase, i.e., does not increase at the same rate as the amount of weight of the dust cover 14 being applied to the support pin 12*c* increases. Thus, as shown in FIG. 10, the difference between the since curve showing the weight variation of the dust cover 14 and the torque curve of hinge rapidly widens, thus causing the dust cover 14 to be automatically closed.

Figure 11:
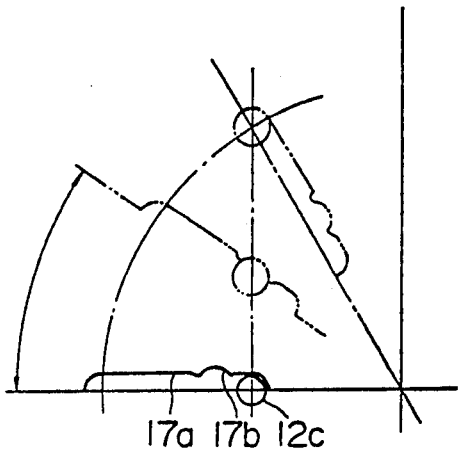
FIG. 11 is an explanatory diagram showing still another embodiment.

FIG. 11 shows still another embodiment of the cam portion formed in the support member. As can be seen in this figure, a recess 17*b* is formed at the intermediate portion of a cam portion 17*a* to receive the support pin 12*c*. With the recess 17*b* formed, the dust cover stops at this position and is supported very stably.

As a further modified embodiment, where the cabinet is a molded product of synthetic resin, the support member may be eliminated to directly install the slider vertically movable in the cabinet. In this case, it is desirable that the mounting portion is made to project from the cabinet and the dust cover be hinged to the mounting portion.

Similar actions and effects can also be obtained if modifications are made to the cam portion by forming various shapes on the side plate of the dust cover.

What is claimed is:

1. In a record player cabinet with a defined hinge receiving space therein, a dust cover hinge for said space which will permit the attached dust cover to pivot open, said hinge comprising in combination:

(a) a hollow elongated hinge support member (3) sized to fit said space, with an inner and an outer end, having a spring case (3*a*) with an inner wall at said inner end and hinge pin support means (3*b*) at said outer end;

(b) a flat slider (4) in said spring case (3*a*) with a defined upper portion, lower end and a front portion, a plurality of recesses (4*a*, 4*b*) in said front portion, an acting pin (4*d*) passing through said upper portion with projections extending out therefrom and an upwardly biased vertical compression coil spring (5) with two ends, one end being connected to said slider lower end and the other end being in said spring case (3*a*), a leaf spring (6) mounted on said spring case inner wall to sequentially engage said slider recesses (4*a*, 4*b*) at predetermined pivoting positions of the hinge; and, (c) a cover support (7) with a base plate (7*a*), an angle-shaped holder (7*b*) on said base plate, follower means (7*c*) under said base plate, hinge pin supports (7*d*) and a hinge pin under said follower means, said follower means (7*c*) engaging said acting pin projections, said hinge pin being rotatably mounted to the hinge pin support means (3*b*) by the hinge pin supports (7*d*).

2. In a record player cabinet with a defined hinge receiving space therein, a dust cover hinge for said space which will permit the attached dust cover to pivot open, said hinge comprising in combination:

(a) a hollow elongated hinge support member (11) sized to fit said space, with an inner and an outer end, having a spring case (11*a*) with an inner wall at said inner end and hinge pin support means (11*b*) at said outer end;

(b) a flat slider (12) vertically disposed in said spring case (11*a*) with a defined upper portion, lower end, and, a pair of support pin holders (12*b*) with a support pin (12*b*) passing through said pin holders at said upper portion, an upwardly biased vertical compression coil spring (13) with two ends, one end being connected to said slider lower end and the other end being in said spring case (11*a*), a hinge pin (16); and, (c) a cover support member (15) with a mounting portion (15*b*) and follower means with a cam portion (15*c*) under said base plate, said mounting portion (15*b*) being mounted on said hinge pin supports which are pivotally mounted to the hinge pin (16), said cam portion (15*c*) and support pin (12*c*) being so arranged and disposed that as the dust cover opens, the distance that the support pin (12*c*) moves relative to the cam portion (15*c*) increases radically, and the compression spring (13) gradually overcomes the weight of the dust cover.

3. In a record player as claimed in claim 2 including a recess (17*b*) at the intermediate portion of the cam portion (15*c*) so disposed as to receive the support pin (12*c*).

* * * * *